US005695323A

United States Patent [19]

Pfeifer et al.

[11] Patent Number: 5,695,323

[45] Date of Patent: Dec. 9, 1997

[54] AERODYNAMICALLY OPTIMIZED MID-SPAN SNUBBER FOR COMBUSTION TURBINE BLADE

[75] Inventors: Nathan R. Pfeifer, Orlando; John P. Thomas, Winter Springs; Wally N. Dangerfield, Casselberry, all of Fla.

[73] Assignee: Westinghouse Electric Corporation, Pittsburgh, Pa.

[21] Appl. No.: 635,131

[22] Filed: Apr. 19, 1996

[51] Int. Cl.[6] ..... F01D 5/10

[52] U.S. Cl. ..... 416/190; 416/193 R; 416/196 R; 416/500

[58] Field of Search ..... 416/190, 193 R, 416/194, 195, 196 R, 500; 415/77–79

[56] References Cited

U.S. PATENT DOCUMENTS

| | | | |
|---|---|---|---|
| 2,510,734 | 6/1950 | Bodger | 416/190 |
| 3,216,699 | 11/1965 | Schoenborn | 416/190 |
| 5,275,531 | 1/1994 | Roberts | 416/196 R |

*Primary Examiner*—Christopher Verdnier

[57] ABSTRACT

An aerodynamically optimized mid-span snubber for combustion turbine blades provides sufficient stiffness to ameliorate vibratory stress but does so with minimal degradation of aerodynamic performance. The snubber has an optimized aerodynamic cross-sectional shape that forms when two snubber portions attached to adjacent rotor blades come into contact upon rotation of the rotor at an operational velocity.

7 Claims, 2 Drawing Sheets

AERODYNAMICALLY OPTIMIZED MID-SPAN SNUBBER FOR COMBUSTION TURBINE BLADE

FIELD OF THE INVENTION

The present invention relates generally to the field of combustion turbine engines. More particularly, the present invention relates to a mid-span snubber for improved combustion turbine engine rotor blade reliability.

BACKGROUND OF THE INVENTION

Generally, combustion turbine engines operate by forcing high pressure gas through a combustion turbine. The gas flow path of a combustion gas turbine is formed by a stationary cylinder and a rotor. A large number of stationary vanes are attached to the cylinder in a circumferential array and extend inward into the gas flow path. Similarly, a large number of rotating blades are attached to the rotor in a circumferential array and extend outward into the gas flow path. The stationary vanes and rotating blades are arranged in alternating rows so that a row of vanes and the immediately downstream row of blades forms a stage. The vanes serve to direct the flow of gas so that it enters the downstream row of blades at the correct angle. The blade airfoils extract energy from the high pressure gas, thereby developing the power necessary to drive the rotor and the load attached to it.

The difficulty associated with designing a combustion turbine blade is exacerbated by the fact that the blade design determines, in large part, the mechanical characteristics of the blade—such as its stiffness and resonant frequencies—as well as the aerodynamic performance of the blade. These considerations impose constraints on the choice of blade design. Thus, of necessity, the optimum blade design for a given row is a matter of compromise between its mechanical and aerodynamic properties.

One important mechanical characteristic of a blade is its resistance to stall flutter. Briefly, stall flutter is an aero-elastic instability wherein, under certain flow conditions, vibratory deflections in the airfoil cause changes in the aerodynamic loading on it that tend to increase, rather than dampen, the deflections. Consequently, stall flutter can increase the vibratory stress on the blade and cause high cycle fatigue cracking. The resistance of a blade to stall flutter can be increased by increasing its stiffness.

Mid-span snubbers have been previously used with steam turbine blades to provide stiffness and to alleviate vibratory stress. A mid-span snubber provides additional support to a turbine blade so as to compensate for vibrations and reduce the occurrence of self-excited vibration. Furthermore, the additional strength provided by the snubber allows for a reduced axial blade width which results in lower rotor stress.

Snubbers have not been previously applied to combustion turbine engines largely because the blade lengths in combustion engines did not require the increased stiffness provided by a snubber. However, as the length of combustion turbine blades has increased, the need for additional blade stiffness has arisen.

Unfortunately, changes associated with increasing the stiffness of a blade, such as the addition of snubbers, tend to impair aerodynamic performance. The snubbers that have been previously used in steam turbine engines have not been aerodynamically optimized. Typically, snubbers have taken shapes such as simple ellipses and cylinders without fully considering their aerodynamic impact and associated energy loss. As a result, the aerodynamic effects of the snubber were not fully analyzed to arrive at an optimal aerodynamic design.

It is therefore desirable to provide an aerodynamically optimized snubber for a combustion turbine engine that provides sufficient stiffness to ameliorate vibratory stress but does so with minimal aerodynamic loss.

SUMMARY OF THE INVENTION

Accordingly, the present invention provides an aerodynamically optimized mid-span snubber for a turbine blade. The invention adds strength to the turbine blade with minimal energy loss due to aerodynamic turbulence.

This object is accomplished in a combustion turbine engine by applying the aerodynamically optimized snubber between adjacent combustion turbine blades. The snubber is comprised of two portions, with each portion attached to an adjacent rotor blade. When the combustion engine rotor reaches an operational rate of rotation, the rotor blades untwist, causing each snubber portion to interlock with the portion of the snubber attached to the adjacent rotor blade. The interlocked snubber portions add resistance to vibration and thus decrease the probability of rotor blade failure.

The snubbers have an optimized aerodynamic shape and are positioned on the rotor blades so as to minimize aerodynamic loss. Therefore, the present invention provides an aerodynamically optimized snubber that makes combustion turbine rotor blades more resistant to failure.

Other features of the present invention are described below.

DETAILED DESCRIPTION OF PREFERRED EMBODIMENTS

Figure 1:
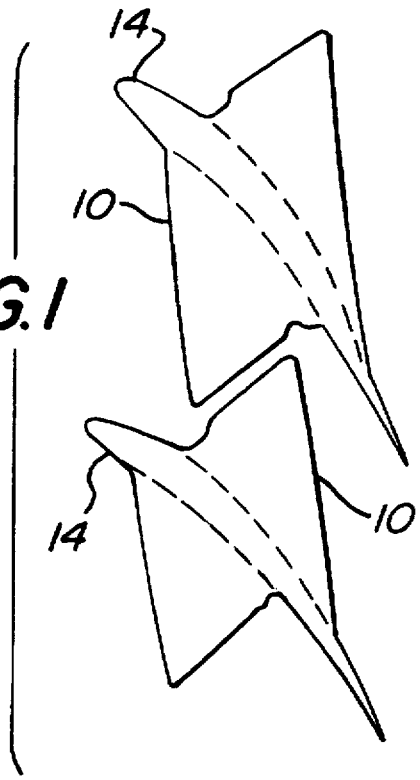
FIG. 1 is a perspective view of two adjacent rotor blades with attached snubber portions in a motionless combustion engine.

FIGS. 1 through 4 depict a presently preferred embodiment of the present invention. FIG. 1 is a perspective view of two adjacent rotor blades 14 with attached snubbers 10 in a motionless combustion engine rotor. As shown, the snubber portions are integrally formed between adjacent rotor blades. Further, a gap exists between the snubber portions. As a result, when the rotor is not moving, adjacent snubber portions do not interlock.

Figure 2:
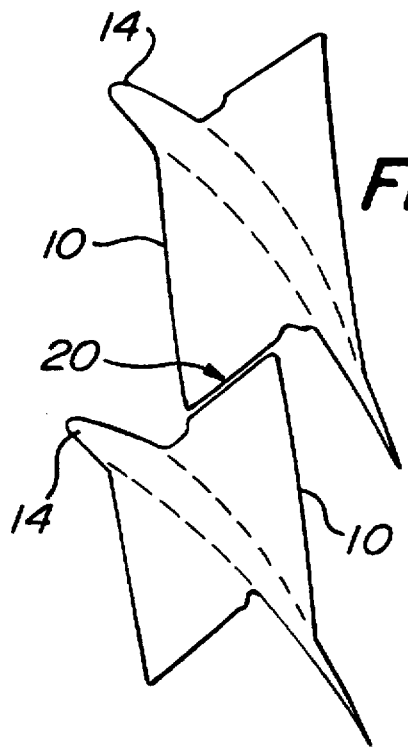
FIG. 2 is a perspective view of two adjacent rotor blades with attached snubber portions in a rotating combustion engine rotor.

FIG. 2 is a perspective view of the same combustion engine rotor blades 14 and snubbers 10 when the rotor has a rotational velocity. As shown, when the rotor rotates at its operational velocity, the snubber portions attached to adjacent rotor blades come into contact and interlock. The interlocking snubber portions form a snubber bridge 20 between the rotor blades. Each snubber portion functions to support the adjacent rotor blade and thus decrease the vibrational stresses on the blade.

Figure 3:
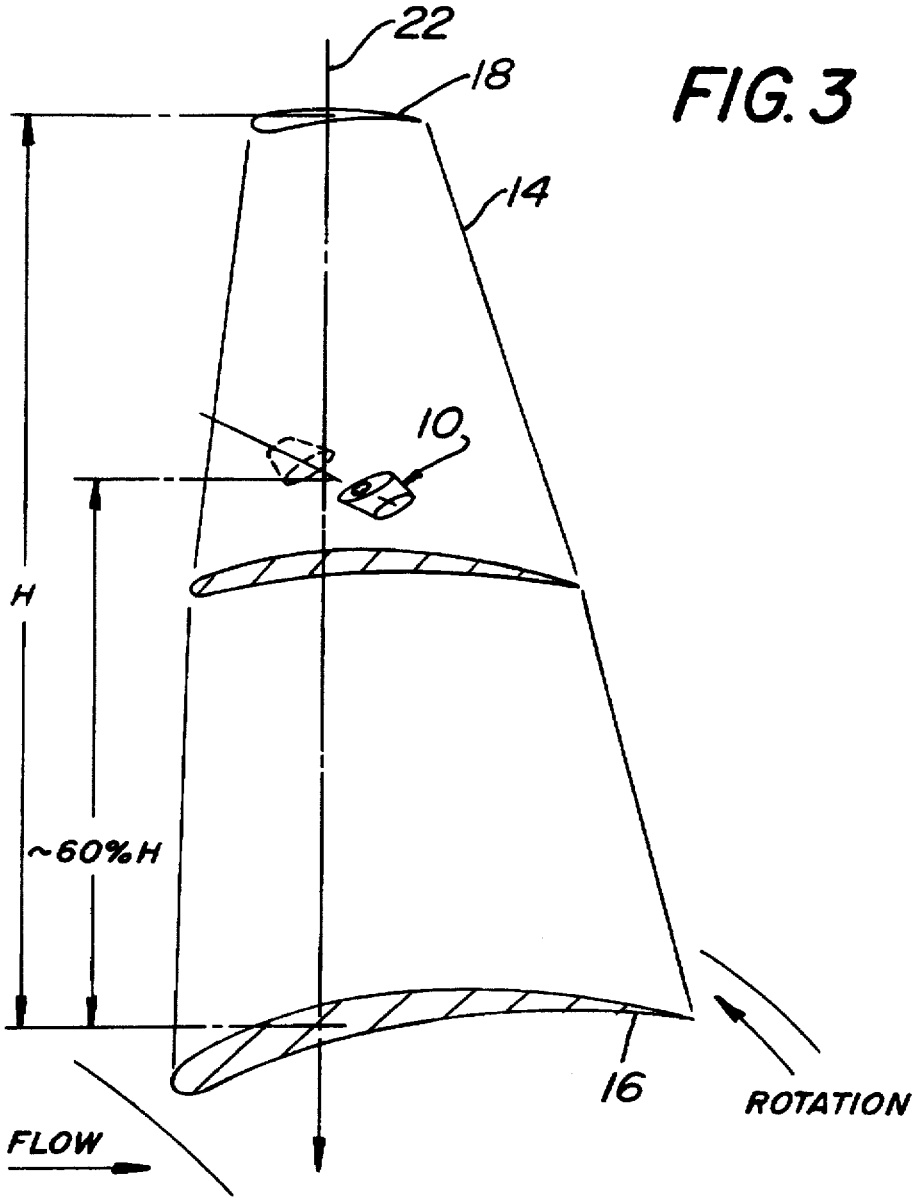
FIG. 3 is a side view, in partial section, of a rotor blade with attached snubber in section.

As shown in FIG. 3, the snubber 10 in the presently preferred embodiment is attached to the rotor blade 14 at a height of approximately 60% of the blade height base 16 and the top 18 of the blade. Furthermore, the snubber is positioned horizontally on the rotor blade by aligning the snubber's center of gravity with the stacking axis 22 of the rotor blade. As is well known in the art, the stacking axis is defined by aligning the centers of gravity of successive theoretical layers of the rotor blade.

Prior art snubbers use simple elliptical and cylindrical shapes, none of which are aerodynamically optimal. Applicants have recognized that the aerodynamically optimized cross-sectional shape of the snubber provides a means for reducing energy losses from snubber induced turbulence.

Figure 4:
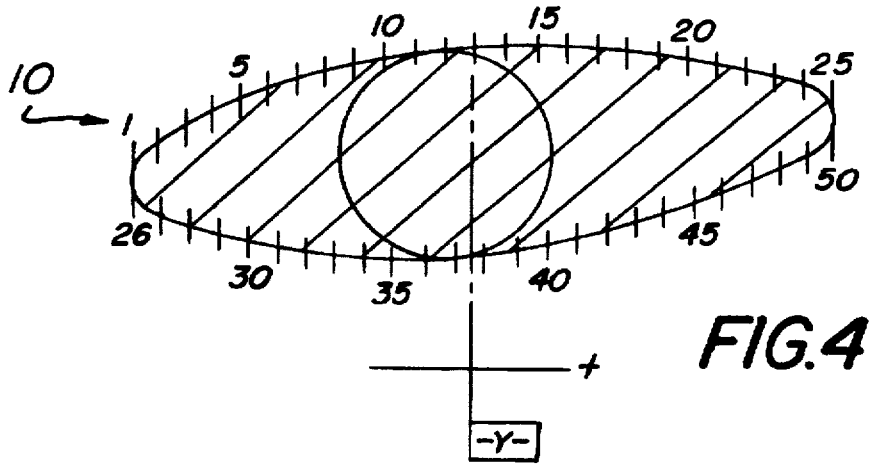
FIG. 4 is a sectional view of the inventive optimized snubber.

FIG. 4 provides a cross-sectional view of the optimized snubber for purposes of illustrating its aerodynamic cross-sectional shape. A cross-sectional view of the snubber is shown on a coordinate system, with the origin located near the center of the snubber cross-sectional area. The coordinate points represent an optimal shape that modeling has shown to produce the least aerodynamic turbulence. (The circle shown in the cross section of the snubber represents the thickest section of the snubber.)

In Table I, the snubber is specified by reference to coordinates of the X and Y axes shown in FIG. 4. The X—Y coordinates of fifty points along the snubber surface define the shape of the snubber cross section. Although the location coordinates shown in Table I define a snubber of a particular size, depending on the units chosen (in the preferred embodiment, the units are in millimeters), the coordinates should be viewed as being essentially non-dimensional, since the invention could be practiced utilizing a larger or smaller snubber, having the same shape, by appropriately scaling the coordinates so as to obtain multiples or fractions thereof—i.e., by multiplying each coordinate by a common factor. The specific coordinate points describing the aerodynamic shape are expressed in Table I below.

TABLE I (Snubber Cross Section X-Y Coordinates)

| Point | Surface Coordinate | Point | Surface Coordinate |
|---|---|---|---|
| N | X Y | N | X Y |
| 1 | (−10.464, −0.557) | 2 | (−9.711, 0.067) |
| 3 | (−8.880, 0.541) | 4 | (−8.034, 0.980) |
| 5 | (−7.191, 1.425) | 6 | (−6.333, 1.829) |
| 7 | (−5.461, 2.187) | 8 | (−4.573, 2.488) |
| 9 | (−3.670, 2.720) | 10 | (−2.759, 2.902) |
| 11 | (−1.843, 3.044) | 12 | (−0.924, 3.148) |
| 13 | (−0.002, 3.214) | 14 | (0.922, 3.244) |
| 15 | (1.846, 3.239) | 16 | (2.769, 3.203) |
| 17 | (3.691, 3.132) | 18 | (4.611, 3.028) |
| 19 | (5.528, 2.904) | 20 | (6.445, 2.764) |
| 21 | (7.359, 2.607) | 22 | (8.271, 2.433) |
| 23 | (9.181, 2.247) | 24 | (10.090, 2.054) |
| 25 | (10.999, 1.860) | 26 | (−10.464, −1.765) |
| 27 | (−9.586, −2.108) | 28 | (−8.693, −2.358) |
| 29 | (−7.796, −2.594) | 30 | (−6.902, −2.854) |
| 31 | (−6.003, −3.073) | 32 | (−5.095, −3.240) |
| 33 | (−4.181, −3.352) | 34 | (−3.263, −3.410) |
| 35 | (−2.344, −3.410) | 36 | (−1.426, −3.373) |
| 37 | (−0.509, −3.293) | 38 | (0.405, −3.174) |
| 39 | (1.314, −3.015) | 40 | (2.218, −2.822) |
| 41 | (3.118, −2.599) | 42 | (4.012, −2.348) |
| 43 | (4.900, −2.071) | 44 | (5.784, −1.773) |
| 45 | (6.664, −1.460) | 46 | (7.540, −1.133) |
| 47 | (8.411, −0.787) | 48 | (9.276, −0.423) |
| 49 | (10.138, −0.047) | 50 | (10.999, 0.333) |

In addition to its aerodynamic shape, the presently preferred embodiment of the snubber is attached to the rotor blade at an angle that minimizes aerodynamic loss. As is well known in the art, a gas flow path may be comprised of many gas flow fields. A gas flow field defines the gas flow at a particular location. In the present invention, the optimized snubber is attached to the rotor blade so as to position the snubber bridge at an angle zero degrees relative to the gas flow field that surrounds the snubber bridge. An angle of zero degrees relative to the gas flow field least disturbs the flow field and therefore minimizes aerodynamic loss. In the presently preferred embodiment, with the snubber attached at approximately 60% of the blade height, the snubber is attached at an angle of approximately five degrees relative to the centerline of the engine. This arrangement places the snubber bridge at the desired zero degrees relative to the gas flow field. It should be noted that the angle of the gas flow field varies with the distance from the base 16 of the rotor blade. Therefore, if the height of the snubber is changed, the snubber's angle relative to the centerline of the engine should be adjusted to insure that the snubber bridge forms an angle substantially zero degrees relative to the gas flow field.

The present invention may be employed in other specific forms without departing from the spirit or essential attributes thereof. For example, the snubber might be attached to the rotor blade at heights other than 60% of the blade height. Changes to the snubber height will require modifying the angle of the snubber relative to the centerline of the engine so as to maintain the snubber bridge's zero degree inflection relative to the gas flow. Accordingly, the scope of protection of the following claims is not limited to the presently preferred embodiment disclosed above.

I claim:

1. In a combustion turbine engine having a plurality of gas flow fields, an apparatus comprising:

at least a first and second adjacent rotor blade each having a base and top; and a snubber comprised of a first portion that is attached to said first rotor blade and a second portion that is attached to said second rotor blade wherein said first snubber portion and said second snubber portion substantially align and form a snubber bridge between said first rotor blade and said second rotor blade when said first rotor blade and said second rotor blade rotate at an operational velocity;

wherein said first snubber portion and said second snubber portion have a cross-sectional shape with a profile defined as follows, where N is a number of a point on a surface of the snubber profile, X represents a distance having a unit of measurement from a reference point in an abscissa direction and Y represents a distance having a unit of measurement from a reference point in an ordinate direction:

| Point | Surface Coordinate | Point | Surface Coordinate |
|---|---|---|---|
| N | X Y | N | X Y |
| 1 | (−10.464, −.557) | 2 | (−9.711, 0.067) |
| 3 | (−8.880, 0.541) | 4 | (−8.034, 0.980) |
| 5 | (−7.191, 1.425) | 6 | (−6.333, 1.829) |
| 7 | (−5.461, 2.187) | 8 | (−4.573, 2.488) |
| 9 | (−3.670, 2.720) | 10 | (−2.759, 2.902) |
| 11 | (−1.843, 3.044) | 12 | (−0.924, 3.148) |
| 13 | (−0.002, 3.214) | 14 | (0.922, 3.244) |
| 15 | (1.846, 3.239) | 16 | (2.769, 3.203) |
| 17 | (3.691, 3.132) | 18 | (4.611, 3.028) |
| 19 | (5.528, 2.904) | 20 | (6.445, 2.764) |
| 21 | (7.359, 2.607) | 22 | (8.271, 2.433) |
| 23 | (9.181, 2.247) | 24 | (10.090, 2.054) |
| 25 | (10.999, 1.860) | 26 | (−10.464, −1.765) |

-continued

| Point N | Surface Coordinate X | Y | Point N | Surface Coordinate X | Y |
|---|---|---|---|---|---|
| 27 | (−9.586, | −2.108) | 28 | (−8.693, | −2.358) |
| 29 | (−7.796, | −2.594) | 30 | (−6.902, | −2.854) |
| 31 | (−6.003, | −3.073) | 32 | (−5.095, | −3.240) |
| 33 | (−4.181, | −3.352) | 34 | (−3.263, | −3.410) |
| 35 | (−2.344, | −3.410) | 36 | (−1.426, | −3.373) |
| 37 | (−0.509, | −3.293) | 38 | (0.405, | −3.174) |
| 39 | (1.314, | −3.015) | 40 | (2.218, | −2.822) |
| 41 | (3.118, | −2.599) | 42 | (4.012, | −2.348) |
| 43 | (4.900, | −2.071) | 44 | (5.784, | −1.773) |
| 45 | (6.664, | −1.460) | 46 | (7.540, | −1.133) |
| 47 | (8.411, | −0.787) | 48 | (9.276, | −0.423) |
| 49 | (10.138, | −0.047) | 50 | (10.999, | 0.333). |

2. An apparatus as recited in claim 1 wherein said unit of measurement is defined in millimeters.

3. An apparatus as recited in claim 1 wherein said first snubber portion is attached to said first rotor blade at approximately 60% of the distance from the rotor blade base of said first rotor blade to the rotor blade top of said first rotor blade and said second snubber portion is attached to said second rotor blade at approximately 60% of the distance from the rotor blade base of said second rotor blade to the rotor blade top of said second rotor blade.

4. An apparatus as recited in claim 1 wherein said first snubber portion is attached to said first rotor blade at a horizontal position defined by aligning the center of gravity of said first snubber portion with the stacking axis of said first rotor blade and said second snubber portion is attached to said second rotor blade at a horizontal position defined by aligning the center of gravity of said second snubber portion with the stacking axis of said second rotor blade.

5. In a combustion turbine engine having a plurality of gas flow fields, an apparatus comprising:

at least first and second adjacent rotor blades each having a base and a top;

a snubber comprised of a first portion that is attached to said first rotor blade and a second portion that is attached to said second rotor blade wherein said first snubber portion and said second snubber portion substantially align and form a snubber bridge between said first rotor blade and said second rotor blade when said first rotor blade and said second rotor blade rotate at an operational velocity;

wherein said first snubber portion is attached to said first rotor blade at approximately 60% of the distance from the rotor blade base of said first rotor blade to the rotor blade top of said first rotor blade and said second snubber portion is attached to said second rotor blade at approximately 60% of the distance from the rotor blade base of said second rotor blade to the rotor blade top of said second rotor blade;

wherein said first snubber portion is attached to said first rotor blade at a horizontal position defined by aligning the center of gravity of said first snubber portion with the stacking axis of said first rotor blade and said second snubber portion is attached to said second rotor blade at a horizontal position defined by aligning the center of gravity of said second snubber portion with the stacking axis of said second rotor blade;

wherein said first snubber portion and said second snubber portion have a cross-sectional shape with a profile defined as follows, where N is a number of a point on a surface of the snubber profile, X represents a distance from a reference point in an abscissa direction and Y represents a distance from a reference point in an ordinate direction:

| Point N | Surface Coordinate X | Y | Point N | Surface Coordinate X | Y |
|---|---|---|---|---|---|
| 1 | (−10.464, | −.557) | 2 | (−9.711, | 0.067) |
| 3 | (−8.880, | 0.541) | 4 | (−8.034, | 0.980) |
| 5 | (−7.191, | 1.425) | 6 | (−6.333, | 1.829) |
| 7 | (−5.461, | 2.187) | 8 | (−4.573, | 2.488) |
| 9 | (−3.670, | 2.720) | 10 | (−2.759, | 2.902) |
| 11 | (−1.843, | 3.044) | 12 | (−0.924, | 3.148) |
| 13 | (−0.002, | 3.214) | 14 | (0.922, | 3.244) |
| 15 | (1.846, | 3.239) | 16 | (2.769, | 3.203) |
| 17 | (3.691, | 3.132) | 18 | (4.611, | 3.028) |
| 19 | (5.528, | 2.904) | 20 | (6.445, | 2.764) |
| 21 | (7.359, | 2.607) | 22 | (8.271, | 2.433) |
| 23 | (9.181, | 2.247) | 24 | (10.090, | 2.054) |
| 25 | (10.999, | 1.860) | 26 | (−10.464, | −1.765) |
| 27 | (−9.586, | −2.108) | 28 | (−8.693, | −2.358) |
| 29 | (−7.796, | −2.594) | 30 | (−6.902, | −2.854) |
| 31 | (−6.003, | −3.073) | 32 | (−5.095, | −3.240) |
| 33 | (−4.181, | −3.352) | 34 | (−3.263, | −3.410) |
| 35 | (−2.344, | −3.410) | 36 | (−1.426, | −3.373) |
| 37 | (−0.509, | −3.293) | 38 | (0.405, | −3.174) |
| 39 | (1.314, | −3.015) | 40 | (2.218, | −2.822) |
| 41 | (3.118, | −2.599) | 42 | (4.012, | −2.348) |
| 43 | (4.900, | −2.071) | 44 | (5.784, | −1.773) |
| 45 | (6.664, | −1.460) | 46 | (7.540, | −1.133) |
| 47 | (8.411, | −0.787) | 48 | (9.276, | −0.423) |
| 49 | (10.138, | −0.047) | 50 | (10.999, | 0.333) |

and wherein said first snubber portion is attached to said first rotor blade such that said snubber bridge is oriented substantially zero degrees relative to one of the plurality of gas flow fields and said second snubber portion is attached to said second rotor blade such that said snubber bridge is oriented substantially zero degrees relative to one of the plurality of gas flow fields.

6. In a turbine engine having a plurality of gas flow fields and a rotor comprised of a plurality of rotor blades disposed in a circumferential array, an apparatus for strengthening the rotor blades comprising:

a snubber disposed between adjacent rotor blades of said plurality of rotor blades, said snubber comprising a first portion and a second portion, wherein said first portion is attached to one of said adjacent rotor blades and said second portion is attached to another of said adjacent rotor blades such that said first portion and said second portion interlock to form a snubber bridge between said adjacent rotor blades when said adjacent rotor blades rotate at an operational velocity;

wherein said first snubber portion and said second snubber portion have a cross-sectional shape with a profile defined as follows, where N is a number of a point on a surface of the snubber profile, X represents a distance from a reference point in an abscissa direction and Y represents a distance from a reference point in an ordinate direction:

| Point N | Surface Coordinate X | Y | Point N | Surface Coordinate X | Y |
|---|---|---|---|---|---|
| 1 | (−10.464, | −.557) | 2 | (−9.711, | 0.067) |
| 3 | (−8.880, | 0.541) | 4 | (−8.034, | 0.980) |
| 5 | (−7.191, | 1.425) | 6 | (−6.333, | 1.829) |
| 7 | (−5.461, | 2.187) | 8 | (−4.573, | 2.488) |

-continued

| Point N | Surface Coordinate X Y | Point N | Surface Coordinate X Y |
|---|---|---|---|
| 9 | (−3.670, 2.720) | 10 | (−2.759, 2.902) |
| 11 | (−1.843, 3.044) | 12 | (−0.924, 3.148) |
| 13 | (−0.002, 3.214) | 14 | (0.922, 3.244) |
| 15 | (1.846, 3.239) | 16 | (2.769, 3.203) |
| 17 | (3.691, 3.132) | 18 | (4.611, 3.028) |
| 19 | (5.528, 2.904) | 20 | (6.445, 2.764) |
| 21 | (7.359, 2.607) | 22 | (8.271, 2.433) |
| 23 | (9.181, 2.247) | 24 | (10.090, 2.054) |
| 25 | (10.999, 1.860) | 26 | (−10.464, −1.765) |
| 27 | (−9.586, −2.108) | 28 | (−8.693, −2.358) |
| 29 | (−7.796, −2.594) | 30 | (−6.902, −2.854) |
| 31 | (−6.003, −3.073) | 32 | (−5.095, −3.240) |
| 33 | (−4.181, −3.352) | 34 | (−3.263, −3.410) |
| 35 | (−2.344, −3.410) | 36 | (−1.426, −3.373) |
| 37 | (−0.509, −3.293) | 38 | (0.405, −3.174) |
| 39 | (1.314, −3.015) | 40 | (2.218, −2.822) |
| 41 | (3.118, −2.599) | 42 | (4.012, −2.348) |
| 43 | (4.900, −2.071) | 44 | (5.784, −1.773) |

-continued

| Point N | Surface Coordinate X Y | Point N | Surface Coordinate X Y |
|---|---|---|---|
| 45 | (6.664, −1.460) | 46 | (7.540, −1.133) |
| 47 | (8.411, −0.787) | 48 | (9.276, −0.423) |
| 49 | (10.138, −0.047) | 50 | (10.999, 0.333). |

7. An apparatus as recited in claim 6 wherein said first snubber portion is attached to one of said plurality of rotor blades such that said snubber bridge is oriented substantially zero degrees relative to one of the plurality of gas flow fields and said second snubber portion is attached to a second adjacent rotor blade of said plurality of rotor blades such that said snubber bridge is oriented substantially zero degrees relative to one of the plurality of gas flow fields.

* * * * *